US011988051B2

(12) United States Patent
Jostes et al.

(10) Patent No.: US 11,988,051 B2
(45) Date of Patent: May 21, 2024

(54) CONTROL FOR A RETAINER OF A TRANSFER DEVICE FOR A ROD SECTION OF A GROUND DRILLING DEVICE

(71) Applicant: TRACTO-TECHNIK GmbH & Co. KG, Lennestadt (DE)

(72) Inventors: Lucas Jostes, Finnentrop (DE); Andre Schnütgen, Lennestadt (DE); Dieter Wurm, Kirchhundem (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 17/873,272

(22) Filed: Jul. 26, 2022

(65) Prior Publication Data

US 2023/0091417 A1 Mar. 23, 2023

(51) Int. Cl.

| | |
|---|---|
| ***E21B 19/15*** | (2006.01) |
| ***E21B 19/087*** | (2006.01) |
| ***E21B 19/14*** | (2006.01) |
| ***E21B 19/20*** | (2006.01) |

(52) U.S. Cl.

CPC ..... *E21B 19/087* (2013.01); *E21B 19/14* (2013.01); *E21B 19/15* (2013.01); *E21B 19/20* (2013.01)

(58) Field of Classification Search

CPC ..... E21B 19/14; E21B 19/15; E21B 19/20; E21B 19/55

See application file for complete search history.

(56) References Cited

U.S. PATENT DOCUMENTS

| | | | | |
|---|---|---|---|---|
| 2010/0104401 | A1 | 4/2010 | Hopkins et al. | |
| 2011/0200413 | A1* | 8/2011 | Hermes | E21B 19/15 414/22.62 |

FOREIGN PATENT DOCUMENTS

| | | | |
|---|---|---|---|
| DE | 10110094 | A1 | 9/2001 |
| DE | 102 06 645 | A1 | 8/2003 |
| DE | 10 2009 035 277 | A1 | 2/2011 |
| EP | 3722552 | A2 | 10/2020 |

OTHER PUBLICATIONS

Translation for DE 10206645 (Year: 2023).*

* cited by examiner

*Primary Examiner* — Giovanna Wright
(74) *Attorney, Agent, or Firm* — Leason Ellis LLP

(57) ABSTRACT

The invention relates to a control for at least one retainer of a transfer device for a rod section of a ground drilling device, wherein the ground drilling device is configured for moving a drill string, and the transfer device is configured for transferring the received rod section from a position in a rod magazine to a position on the drill string or vice versa, and the control is configured to move the retainer between a position above the rod magazine and the position on the drill string while the drill string is still moving.

7 Claims, 4 Drawing Sheets

CONTROL FOR A RETAINER OF A TRANSFER DEVICE FOR A ROD SECTION OF A GROUND DRILLING DEVICE

FIELD OF THE INVENTION

The invention relates to a control for a retainer of a transfer device for a rod section of a ground drilling device, a transfer device for a rod section of a ground drilling device, a ground drilling device with a control, a method for transferring a rod section of a ground drilling device and a use of a control of a transfer device for a rod section of a ground drilling device.

BACKGROUND

When drilling in the ground using a drill string made up of rod sections, it is usual to remove the individual rod sections from a rod magazine using a transfer device and to bring them into a position at the end of the drill string in order to extend the already drilled drill string with the rod section that has been provided.

For example, DE 10 2009 035 277 A1 discloses a drilling device that has a rod magazine with a plurality of rod sections stored therein, a drill carriage and a transfer device with which the rod sections can be removed from the rod magazine and positioned in the drill carriage. The rod magazine is positioned next to a base support of the drill carriage. The rod magazine has the shape of a cuboid and is made up of a plurality of frame profiles connected to one another. The top of the rod magazine is open so that the transfer device can be moved into the rod magazine and a rod section can be removed. The transfer device is connected via a support frame both to an outer wall of the rod magazine and to the base support of the drill carriage. Horizontally aligned toothed racks are present on the support frame, which mesh with drive gears of a drive. A gripping unit of the transfer device can be moved in the horizontal direction along the horizontal toothed racks.

It has been found that known drilling devices achieve good results, but the time it takes to carry out a ground drilling can be perceived by users as too long.

SUMMARY

The invention is now based on the object of providing a control, a transfer device, a ground drilling device, a method for transferring a rod section of a ground drilling device and a use of a control of a transfer device for a rod section of a ground drilling device, in which in particular the time for forming a borehole is reduced.

The object is attained by the subject matters of the independent claims. Advantageous embodiments are the subject of the dependent claims and the description.

DETAILED DESCRIPTION

Figure 1:
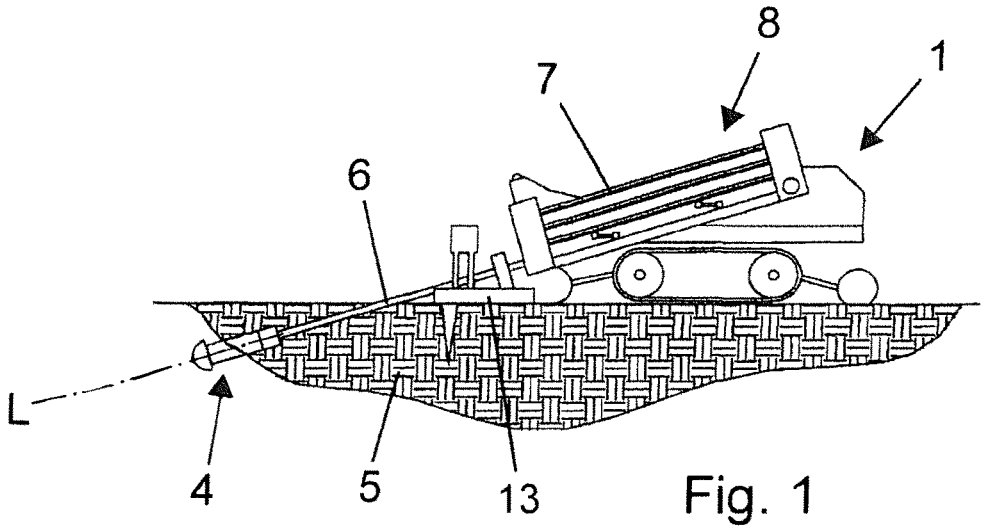
FIG. 1 shows a schematic view of a ground drilling device with a drill string in a side view in a partially sectioned representation.

The core idea of the invention is to bring the transfer device, while the drill string is still moving, into a position which allows the borehole to be formed in the ground more quickly. A simple rod magazine can be used, from which the rod sections can be removed from above. The transfer device can already bring at least one retainer, which can pick up, move and deposit the rod section, into an advantageous position both when the ground drilling device is in pulling operation and when the ground drilling device is in pushing operation. The advantageous position is between the inside of the rod magazine and the position of the rod section on the drill string. The retainer can already be brought to the drill string while the ground drilling device is still in pulling or pushing operation, in order to then subsequently introduce a new rod section into the drill string or remove a rod section from the end of the drill string.

The inventors have recognized that the transfer device can be used not only for the direct route of the rod section between the rod magazine and the position on the drill string, but that there can also be one or more intermediate positions in which the transfer device can move the retainer or the rod section through the ground drilling device even while the drill string is being pulled or pushed. While in the prior art a route or path for the rod section is specified, which essentially consists of several rectilinear, in particular direct, movements, in which there is at least one uninterrupted rectilinear movement from above and into the position on the drill string, the at least one or more positions provide one or more "intermediate position(s)" with which there may be at least an interruption of the continuous rectilinear movement provided in the prior art, wherein the moving of the rod section into this position or positions still takes place during the movement of the drill string. While the actual drilling or pulling-in or widening is progressing, the transfer device can be simultaneously moved, without affecting the actual drive of the drill string (rotation, feed or retraction), into a position, which on the one hand does not impede the traversing path of the drive, but on the other hand also provides the shortest possible distance to the position on the drill string in order to bring a rod section to the end or a position on the drill string or to remove a rod section from the position on the drill string (end of the drill string). From the "intermediate position" or the "intermediate positions", the transfer device can reach the drill string or a position on the drill string relatively quickly, so that it is hardly necessary to interrupt the actual drilling or pull-in progress in order to introduce or remove a new rod section to be connected to the drill string, or for the removal of a rod section separated from the drill string.

A significant advantage or added value is created by the invention in that the ground drilling can be carried out more quickly. Initial waiting or dead times during which the rod section has to be transported can be shortened. This can result in a shortening of the work cycles, since the actual drilling, pulling-in or expanding process can be continued in parallel during a large part of the movement of the transfer device. Although the working cycle or working cycles can be shortened, no additional components are absolutely necessary.

It was recognized that based on the idea of moving the rod section while the drill string is still moving, a synergistic effect can be achieved if the rod magazine is modified in a further embodiment of the invention. The synergistic effect comes to light in particular when a rod section is transported from the rod magazine in the direction of the drill string. The modification can be seen as providing a recess on the rod magazine through which the rod section can be moved out of the rod magazine, particularly without having moved the rod section over the top edge of the rod magazine. The recess is preferably arranged in the wall of the rod magazine, which is an end wall of the rod magazine; furthermore, the wall preferably faces the entry of the drill string into the ground. Through the recess, a rod section can be moved so far forward, without having already been moved in the direction of the drill string, that the end of the rod section facing the entry of the drill string into the ground is essentially centered over a clamping and release device of the ground drilling device, with which the drill string can be clamped and released. Using the clamping and release device, the drill string can be clamped during the rod change, ie the connection to another rod section or the removal of the last rod section from the drill string, without the drill string moving significantly along the longitudinal direction of the drill string. The rod section to be attached to the drill string from the rod magazine can be moved so far forward through the recess that only a short horizontal and vertical movement is required to bring the rod section into the longitudinal axis of the drill string and then connect the rod section with the drill string. By providing a recess in the rod magazine, the possibility can be created of leaving the rod section in a position that is favorable for working. The position can be defined in that it is a position above a surface that results from a translational movement of a projection of the frame of the rod magazine or the base of the rod magazine along the longitudinal axis of the rod magazine in the direction of the entry of the drill string into the ground. It initially seems paradoxical that an advantage can be achieved without moving the rod section in the direction of the longitudinal axis of the drill string from the rod magazine. Nevertheless, a decisive added value can be achieved for the user. The movement of the rod section made possible by the recess in the rod magazine can be a translational movement out of the rod magazine along the longitudinal axis of the rod magazine, in particular essentially parallel to the drill string.

In the context of the description, the term recess includes a passage, a breakthrough, an opening and/or a hole, the passage, breakthrough, opening and/or the hole can be surrounded at least partially, in particular completely, at the edge with material.

The invention provides a control for at least one retainer of a transfer device for a rod section of a ground drilling device. The ground drilling device is designed to move a drill string. The transfer device is designed to transfer the received rod section from a position in a rod magazine to a position on the drill string or vice versa. The control is designed in such a way that it moves the retainer between a position above the rod magazine and the position on the drill string while the drill string is still moving.

The term "control" in the sense of the description includes a design using a hardware and/or software, by means of which a directed influencing of the retainer and the transfer device during operation, ie for handling or moving the rod section, is possible. The control can be a hardware component and/or have a software component. The control can be present as a separate hardware component (module) that is integrated into a control for a ground drilling device and/or can be functionally linked to it. The hardware component can be designed electrically or electronically. A hardware component of the control can also be implemented at least partially in the control of the ground drilling device. The hardware component can use a processor to operate the ground drilling device, so that the hardware component can be at least partially identical or identical to the hardware for controlling the ground drilling device. Alternatively or additionally, the control can comprise a command sequence as a software component, which can be executed on a processor, which can be designed as a separate processor (separate hardware component) or can be designed as a processor of the ground drilling device. A processor within the meaning of the description comprises an arithmetic unit, which can be designed using electronic circuits in order to execute instructions, in particular of a computer program. In a preferred embodiment, the control also includes a sequence of instructions executable on a processor. The command sequence can be designed in the form of a (computer) program. The command sequence can act in a directed or targeted manner on the retainer and the transfer device in order to move, grip and/or remove a rod section in a targeted manner.

The term "transfer device" in the sense of the description includes a device for picking up or lifting, moving and/or removing of a rod section, in particular by means of one or more retainers which can be part of the transfer device. The transfer device can be designed both to transfer a rod section from the rod magazine to the drill string axis or a position on the drill string (pushing in of a ground bore) and to transfer a rod section from the drill string axis or a position on the drill string to the rod magazine (a traction or pulling is exerted on the drill rod and the drill rod is pulled out of the ground).

Due to its structural configuration, the transfer device can offer a possibility for moving the at least one retainer, by means of which a rod section can be received or gripped in particular in the rod magazine and can be moved into a position on the drill string. It may also be possible that the transfer device can move a rod section from a position on the drill string into the rod magazine. The retainer can be moved vertically and horizontally, both transversely and longitudinally parallel to the drill string or the drill string axis. In particular, the transfer device can essentially be designed like the transfer device known from DE 10 2009 035 277 A1.

The term "retainer" as used in the specification includes a means of lifting and/or moving a rod section that can be abutted or engaged with the rod section. In particular, a "retainer" can be designed as a gripping device; however, other embodiments are also possible as an alternative—without a gripping device—or additionally in combination with a gripping device. A retainer can have a magnet or electromagnet, for example, with which the rod section or a magnet or magnetized portion arranged on the rod section can interact in order to at least temporarily form a detachable connection between the retainer and the rod section. The rod section can be picked up and put down using the retainer. If the retainer moves with a rod section that has been received, the retainer can be moved together with the rod section.

Usually, a retainer can be designed as a gripping device. The gripping device can grip a rod section at least in portions along a peripheral portion. For this purpose, the gripping device can have one, two or more gripping elements movable towards or away from a fixed element or towards or away from each other, for example in the form of gripping jaws, clamping jaws, gripping clamps, fingers or the like.

The transfer device can have at least one, preferably more than one, in particular two, retainers. The one or more retainers can be designed as a gripping device. The, in particular two, gripping devices can be arranged on a common element, for example a beam, of the transfer device with a longitudinal axial distance from one another.

The term "rod section" in the sense of the description includes individual, in particular rigid, rod sections which can be connected directly or indirectly to one another and which can be connected to one another in the longitudinal axial direction to form a drill rod or a drill string. For connection to one another, the rod sections can be plugged or screwed together with the mechanical interposition of an intermediate element or without the interposition of an intermediate element. Mixed forms of plugging together and screwing together are possible. The connection can be secured by means of a securing element, which prevents the plugging or screwing connection from being loosened. The securing element can be inserted and/or screwed into one of the interconnected rod sections or in both of the interconnected rod sections. In the case of a thread on the securing element, the rod section or rod sections can have a corresponding (counter)thread; however, it can also be provided that at least one of the rod sections does not have a (counter)thread and a further element is inserted into at least one of the rod sections which has the (counter)thread.

The term "drill string" as used in the description includes several interconnected rod sections. At one end, in particular at the front end, the drill string can have a drill head and possibly a drill head tip, which can be designed as a drilling tool (e.g. as an expanding head), or a region adjacent to the drill head, which in particular can have the same orientation as the drill head. In a particularly preferred embodiment, a front portion of a drill string is designed as a drill head or drilling tool. The drill string can also have a sensor portion or a sensor housing in which a sensor is arranged, which allows a position and/or attitude determination of the drill head or of a region adjacent to the drill head. The drill string extends in the longitudinal axial direction along the longitudinal axes of the drill sections in a drill string axis which is substantially congruent or coincident with the longitudinal axes of the drill sections. The drill string axis can essentially be formed by the longitudinal axes of the individual rod sections of the drill string.

The term "ground drilling device" in the sense of the description includes one (and thus any) device which, in particular, can move a drill string having rod sections in a channel in the ground, which is already existing or has to be created, in order to create or widen a bore, in particular a horizontal bore (HD), or pull pipelines or other long bodies into the ground. The ground drilling device can in particular be an HD device. A ground drilling device can be a device that drives a drill string and that can work in particular by displacing ground soil. The drill string can be translationally and/or rotationally introduced into the ground in the longitudinal axial direction of the drill string. The drill string can be moved in the ground by applying tension or pressure.

To drive the drill string, a drive is usually provided in or on the ground drilling device, which can exert a translational and/or rotational force on the drill string. The drill string can have recesses on its outer side, into which an engagement element, which can be moved by the drive, can engage in order to move the drill string essentially in its longitudinal axial extension (drill string axis). The recesses provided on the outer side of the drill string can be designed as recesses formed on the outside of the rod sections, which are in particular formed like grooves. A recess can run at least in portions along the circumference; in particular, a recess can extend completely around the circumference of the rod section. There may be more than one recess per rod section. The engagement element can be designed in the form of a pawl, which can engage in a recess on the drill string (rod section). More than one engagement element can engage the drill string and be moved by the drive. The pawl or pawls may be mounted on a reciprocating carriage or a linear actuator. In the case of a reciprocating carriage, in one direction, for example the "forward" direction, the driving force can be applied to the drill string, and then by means of the movement in the "backward" direction the carriage can be moved back without engagement with the pawl(s), to move back into position for further engagement with the pawl(s). The "forward" direction corresponds to a "working stroke" and the "backward" direction to an "idle stroke".

The drive can be arranged on a drill carriage, which can be designed as a mobile frame. The drive can also be arranged on or at a frame. A drive having a carriage can reciprocate on the drill carriage or frame in the direction of the drill string axis in order to push or pull the drill string in the ground. The drill carriage or the frame can have one or more clamping devices, via which the drill string or a rod section to be attached can be fixed. It can be provided that a clamping device is provided on the drill carriage or the frame, by means of which the free end of the drill string can be fixed in order to enable a new rod section to be connected to the already drilled-in drill string.

The term "soil" within the meaning of the description includes any type of material, in particular earth, sand, rock, boulders and/or stones in which preferably at least partially horizontal channels or bores are either already present or have to be created. An underground arrangement of the soil is preferred, but not absolutely necessary.

A "rod magazine" within the meaning of the description can be a volume or space that is predetermined by means of at least one frame provided in portions, in which rod sections can be stored, in particular lying down. The volume or space can be surrounded by at least partially perforated surfaces that do not have to be closed. In particular, the rod magazine is designed to be open at the top. The rod magazine can have two end elements or head pieces on which separating elements can be provided. In particular, the separating elements can be directed towards one another in order to specify a division or compartments or rows of the rod sections in the rod magazine. The separating elements can extend over the entire length between the end elements. It is also possible that the separating elements or some of the separating elements only extend over a partial length of the length between the two end elements. The term "rod magazine" in the sense of the description also includes a rod magazine as is known from DE 10 2009 035 277 A1.

A rod magazine enables the rod sections to be arranged in a substantially horizontal arrangement. In the rod magazine, the rod sections can rest on one another in direct contact between two rod sections which respectively lie directly on one another. Neighboring rod sections in a compartment, which can in particular be arranged one above the other, can contact each other directly. The width of the compartments transverse to the longitudinal axis of the rod magazine, which can coincide with the longitudinal axis of the rod sections or can run parallel thereto, can essentially correspond to the width of a rod section. The compartments can be as wide as a diameter of a rod section (transverse to the longitudinal axis of the rod magazine or the longitudinal axis of a rod section stored in the rod magazine) and be as high as several diameters of the rod sections.

In a rod magazine, positions can be defined by the formation of compartments, at which a rod section can be positioned or arranged or deposited. Due to the horizontal arrangement of the rod sections, not all defined positions are possible when a rod magazine is not fully loaded, since there cannot be empty positions between two adjacent rod sections in terms of height. Because the rod sections can rest on top of each other, there are no empty intermediate positions. On the other hand, only the top rod section of a compartment or a column can (initially) be accessed. The positions defined in the rod magazine by means of the compartments and the diameter or the thickness of the rod sections can be indexed and/or be numbered for the purpose of visualization and/or association. By means of the index and/or the quantity or number a clear assignment of a position in the rod magazine is permitted. There can be an assignment as to whether and which rod section is present at a position in the rod magazine. The assignment can be tracked by means of the control, in particular when a rod section is (newly) stored in the rod magazine, a rod section is rearranged in the rod magazine and/or a rod section is removed from the rod magazine.

The term "above the rod magazine" in relation to the position of a rod section gripped and moved by the one or more retainers includes a position of the retainer or retainers which is higher than the height of the rod magazine. In particular, the term can include a position that is above the volume enclosed by the rod magazine. The term "above the rod magazine" not only describes a specific position of the retainer or retainers, but also a region in which the retainer or retainers can be positioned or arranged. The position describes that the retainer or the retainers have left the rod magazine upwards. The retainer or retainers may be on their way to a position on the drill string axis.

The term "a position on the drill string" in relation to the position of a drill section gripped and moved by the retainer or retainers includes a position at the end of the drill string in which a rod section held or gripped by the retainer or retainers substantially would be present in the drill string axis. The term "a position on the drill string" does not necessarily describe a specific location or position in space, but a region in which a rod section gripped by the retainer or retainers would be present in the drill string axis; In particular, a translational displacement of the retainer or retainers in a direction parallel to the drill string axis is possible without leaving the position on the drill string.

If it is described that the retainer is between the above-mentioned positions, this includes, within the meaning of the description, the possibility that the retainer can stand still or remain in a position between the two positions. However, it can also be provided that the retainer can be moved "dynamically" between the aforementioned positions in that a route and/or several positions between the aforementioned positions ("above the rod magazine" and "a position on the drill string") can be traveled to.

A position between the position "above the rod magazine" and the position "a position on the drill string" can in particular be one or more positions in which at least one of the following criteria is met:

- outside the rod magazine,
- laterally between the rod magazine (ie outside of it) and the drill string axis,
- some diameters or thicknesses of rod sections above the drill string axis,
- some diameters or thicknesses of the rod sections on the side next to the drill string axis and/or
- on the side next to the rod magazine below the upper edge of the rod magazine.

The term "at least" together with the indefinite article "an", which is grammatically adapted to the gender of the following noun, includes, for the purposes of the description, the possibility that one, two, three, four or another integer number of the parts or elements designated by the noun are taken into account or are present.

In a preferred embodiment, the retainer is moved to at least one intermediate position, which is a lowered position of the retainer on a travel path of the retainer between the position above the rod magazine and the position on the drill string. As a result, a particularly simple and efficient position for the retainer can be provided. The retainer only has to be moved a little to be brought into position on the drill string. The term position refers here in particular to the height to which the retainer is brought.

In a particularly preferred embodiment, the at least one intermediate position is above a drilling fluid collection container. In this way, the possibility can be created that the drilling fluid, which can escape from the rod section due to previous use of the rod section, is returned to one of the intermediate positions or several intermediate positions predetermined by the control and thus does not pollute or soil the ground on which the ground drilling device stands. The fluid collection container can be designed as a trough, tub or the like. The fluid collection container can have a drain or overflow in which the collected drill fluid can be discharged. The drilling fluid collected by means of the fluid collection container can be discharged into an anchor plate, for example. The fluid collection container and the anchor plate can be connected to one another by a fluid channel. It can also be provided that the drilling fluid can reach the outlet or the overflow "by means of gravitation" without a predetermined fluid channel by "simply running or dripping down".

An intermediate position can in particular be a position which is a position which lies between a position above the rod magazine and the position on the drill string. The term "intermediate position" represents in particular a simplification in the description.

In a preferred embodiment, the transfer device has a crane-like structure. The crane-like structure can be designed like a portal crane. Such transfer devices are easy to construct and easy to handle.

In a preferred embodiment, on the travel path between the position above the rod magazine and the position on the drill string, there is a storage for a rod section, on which a rod section can be placed and picked up again.

The efficiency of a drilling process can be further increased by means of the additional storage for a rod section. With the additional storage a further degree of freedom for handling the rod sections is achieved. An additional storage can be made available, by means of which, for example, an intermediate place for sorting can be provided.

In a preferred embodiment, the control is designed for sorting the rod sections in the rod magazine. In this way, it can be achieved, among other things, that certain rod sections can be selected from the rod magazine in the form of an automatic work sequence without the need for interaction with an operator. The control can make the selection of a rod section that is provided for lengthening the drill string that has already been drilled into the ground. The selection can be based on different criteria and/or conditions. For example, the selection can be made in that the rod sections in the rod magazine are removed in a predetermined order defined by the control in order to lengthen the drill string. In this respect, the selection can be predetermined by a predetermined order of removal. Sorting can help to optimize the predetermined order of removal, so that the rod sections that are initially unsorted are sorted according to the predetermined order of removal. The criterion or the condition as to how the selection of the rod sections is performed and in what order they are connected to the drill string can be the length of time that the rod section has already been used to drill a borehole. Other criteria or conditions are possible. It is also possible to take more than one condition or criterion into account. The drilling of the borehole can be further optimized by means of the sorting. The sorting can take place when a rod section is stored, for example when the drill rod is pulled in or pulled out (in particular in the case of reaming). A frequently and/or heavily used rod section can thus be sorted downwards in the rod magazine instead of lying in a compartment at the top and "blocking" an access to the underlying rod sections. A rod section which is sorted downwards—unless it is sorted again for access upwards—can therefore only be used after the other overlying rod sections—unless it is sorted upwards again for access—and in particular only when the other rod sections in the rod magazine have reached a similar or worse state of wear than the rod section parameters. While the drive pulls the drill string further out of the ground, the last rod section pulled out of the ground can be optimally sorted or stored in the rod magazine.

The rod sections in the rod magazine can also or alternatively be sorted when the ground drilling device is ramped up or started. Also in this state, the time can be used sensibly to optimize the position of the rod sections in the rod magazine.

A sorting and/or optimized storing of a rod section in the rod magazine can be carried out in parallel with the ramping up and/or moving of the drill string by the drive, allowing the sorting and/or optimized storage to not affect the actual drilling of the borehole or extraction of the drill string. This leads to a further optimization of the drilling time of the borehole and thus to an increased additional benefit for the operator of the borehole device.

The invention also provides a transfer device for a rod section of a ground drilling device. The ground drilling device is designed to move a drill string. The transfer device has at least one retainer for a rod section and is designed to transfer the received rod section from a position in a rod magazine to a position on the drill string or vice versa. The transfer device can be controlled by means of a control, the control being designed to move the retainer between a position above the rod magazine and the position on the drill string while the drill string is still moving.

The invention also provides a ground drilling device with a control as particularly described above and a transfer device as particularly described above. The ground drilling device is designed to move a drill string. The transfer device has at least one retainer for a rod section and is designed to transfer the received rod section from a position in a rod magazine to a position on the drill string or vice versa. The control is designed in such a way that it moves the retainer between a position above the rod magazine and the position on the drill string while the drill string is still moving.

The invention also provides a method for transferring a rod section of a ground drilling device by means of a transfer device which receives the rod section by means of at least one retainer. The ground drilling device is configured to move a drill string and the drill string is transferred from a position in a rod magazine to a position on the drill string or vice versa. The retainer is moved between a position above the rod magazine and the position on the drill string while the drill string is still moving.

The invention also provides a use of a control of a transfer device for a rod section of a ground drilling device. The ground drilling device is designed to move a drill string. The transfer device has at least one retainer for a rod section and is designed to transfer the received rod section from a position in a rod magazine to a position on the drill string or vice versa. The control is used for moving the retainer between a position above the rod magazine and the position on the drill string while the drill string is still moving.

The invention is described in terms of several aspects relating to a control, a transfer device, a ground drilling device, a method and a use. The explanations for the individual aspects complement each other, so that the explanations for the control are also to be understood as explanations of the description for the transfer device or the ground drilling device. Actions in the sense of the method or method steps relating to the method for transferring a rod section of a ground drilling device are also to be understood or disclosed with the description of the control, the transfer device and/or of the ground drilling device. The same applies to the description of the aforementioned use, which is also disclosed by means of the other aspects with regard to features of a use.

The above statements, like the following description of exemplary embodiments, do not represent a waiver of certain embodiments or features.

In the following, the invention will be explained in greater detail with reference to an exemplary embodiment illustrated in drawings.

FIG. 1 shows a schematic view of a ground drilling device 1 for the trench-less laying of lines, such as water, sewage, power or data lines, during the so-called pilot drilling. The ground drilling device 1 is equipped with a rotary drive 2 and a feed drive 3 in order to push or pull a drilling head 4 or a drilling tool through the ground 5. The drill head 4, which is designed asymmetrically for executing controlled bore courses, is arranged at the front end of a drill string 6, which has individual rod sections 7.

Figure 2:
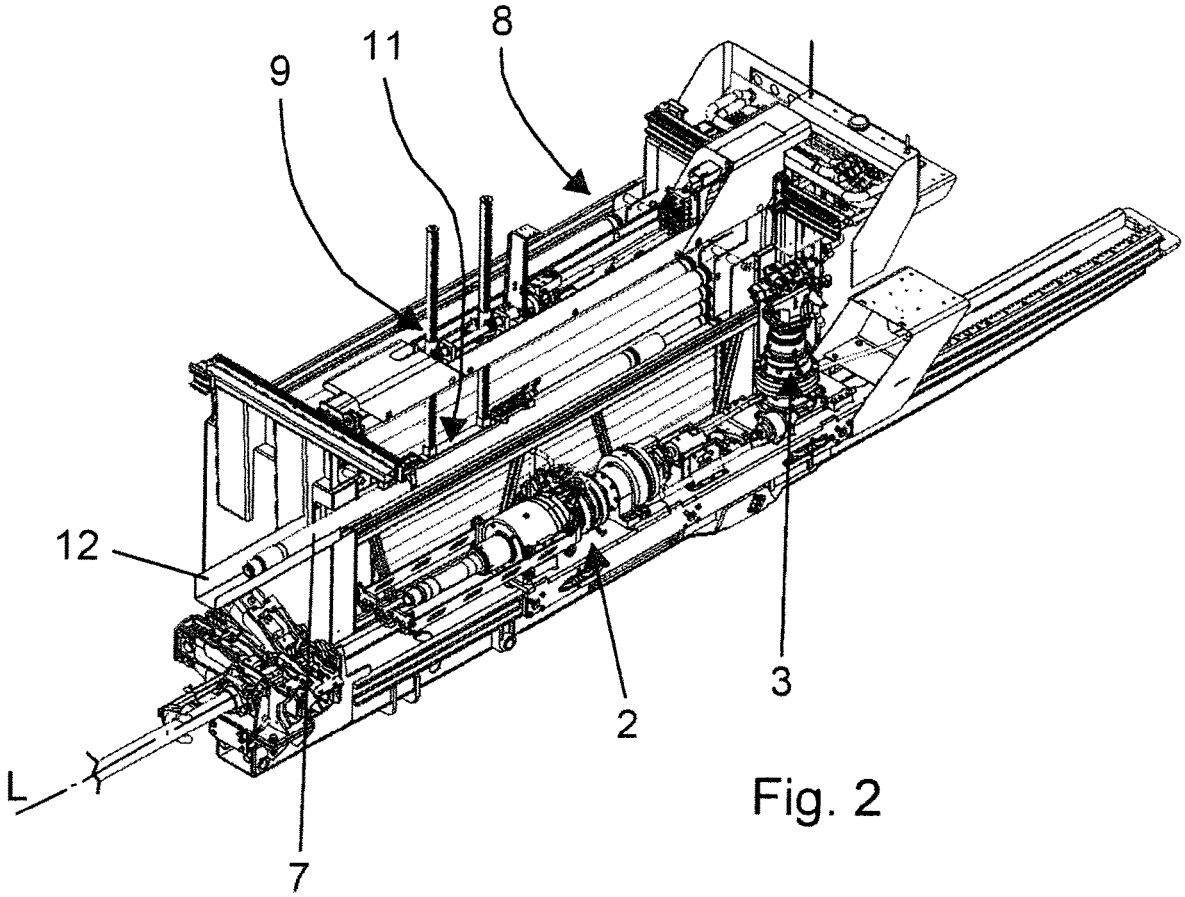
FIG. 2 shows a more detailed illustration of the ground drilling device in the region of a rod magazine and a drive with a transfer device.
Figure 3:
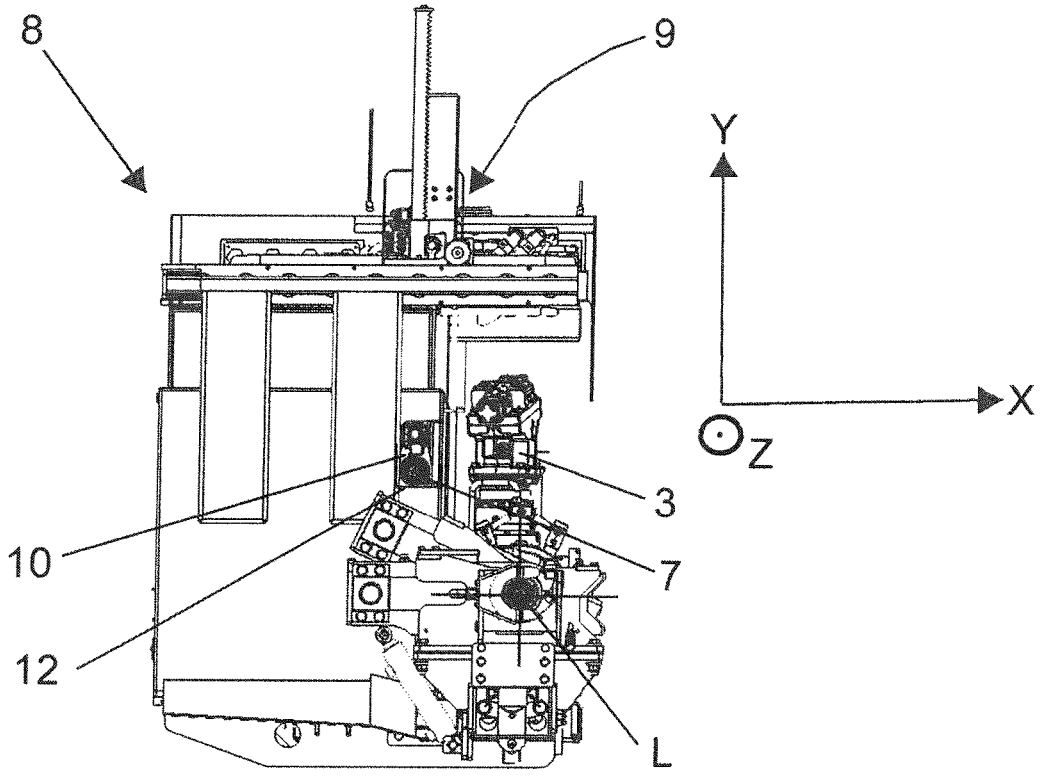
FIG. 3 shows the more detailed representation of the rod magazine, drive and transfer device in a view from the front.

The individual rod sections 7 are held in a rod magazine 8 and, during drilling operation, are removed from the rod magazine 8 by means of a transfer device 9 shown in more detail in FIG. 2 and FIG. 3 and moved into the longitudinal axis L of the drill string 6 in order to be mounted in and therefore lengthen the drill string 6. As can be seen in FIG. 3, the transfer device 9 can move a rod section 7 both transversely (X-axis X) and perpendicularly (Y-axis Y) to the longitudinal axis L of the drill string 6 and enter the rod magazine 8 and grab a rod section 7 with the retainers 10 designed as a gripper, then drive out of the rod magazine 8 again with a rod section 7 and transport the rod section 7 into the longitudinal axis L of the drill string 6 by movements in the direction of the X and Y axes. The retainers 10 are moved to a position on the drill string 6 where the rod section 7 can be added to the drill string 6, which is already running for its main part in the ground 5, to extend it, wherein a movement ultimately is carried out in the direction of the longitudinal axis L (also referred to as the Z axis). in order to bring the rod section 7 to the drill string 6 which is already running predominantly in the ground. The transfer device 9 has a pushing unit 11 for carrying out this last direction of movement.

In order to shorten dead times, a rod section 7 is first transported from the rod magazine 8 into an intermediate position shown in FIGS. 2 and 3 near the longitudinal axis L of the drill string 6. During the movements of the transfer device 9, the pilot bore can be continued without interruption. For the final introduction of a further rod section 7 into the drill string 6, the travel path from the intermediate position in the longitudinal axis L and thus also the dead time in which no drilling progress takes place are now very short, which makes work much more efficient.

Below the position in which a rod section 7 is brought into an intermediate position by means of the transfer device 9, a drainage trough 12 for residual drilling fluid exiting from the deposited rod sections 7 is attached. If a rod section 7 is removed from the drill string 6 while it is being pulled back, there is still a certain residual amount of drilling fluid in such a rod section 7. Normally, the carriage of the ground drilling device 1 is inclined slightly forward (towards the target), so that the residual amount of drilling fluid from each rod section 7 that is deposited in the intermediate position would run out and contaminate the ground drilling device 1 and the surrounding soil. A fluid collection container 12 designed as a (drainage) tub catches the exiting residual amount of drilling fluid and directs it to an underlying anchor plate 13. From here, the drilling fluid can be removed and returned to the drilling process.

Figure 4:
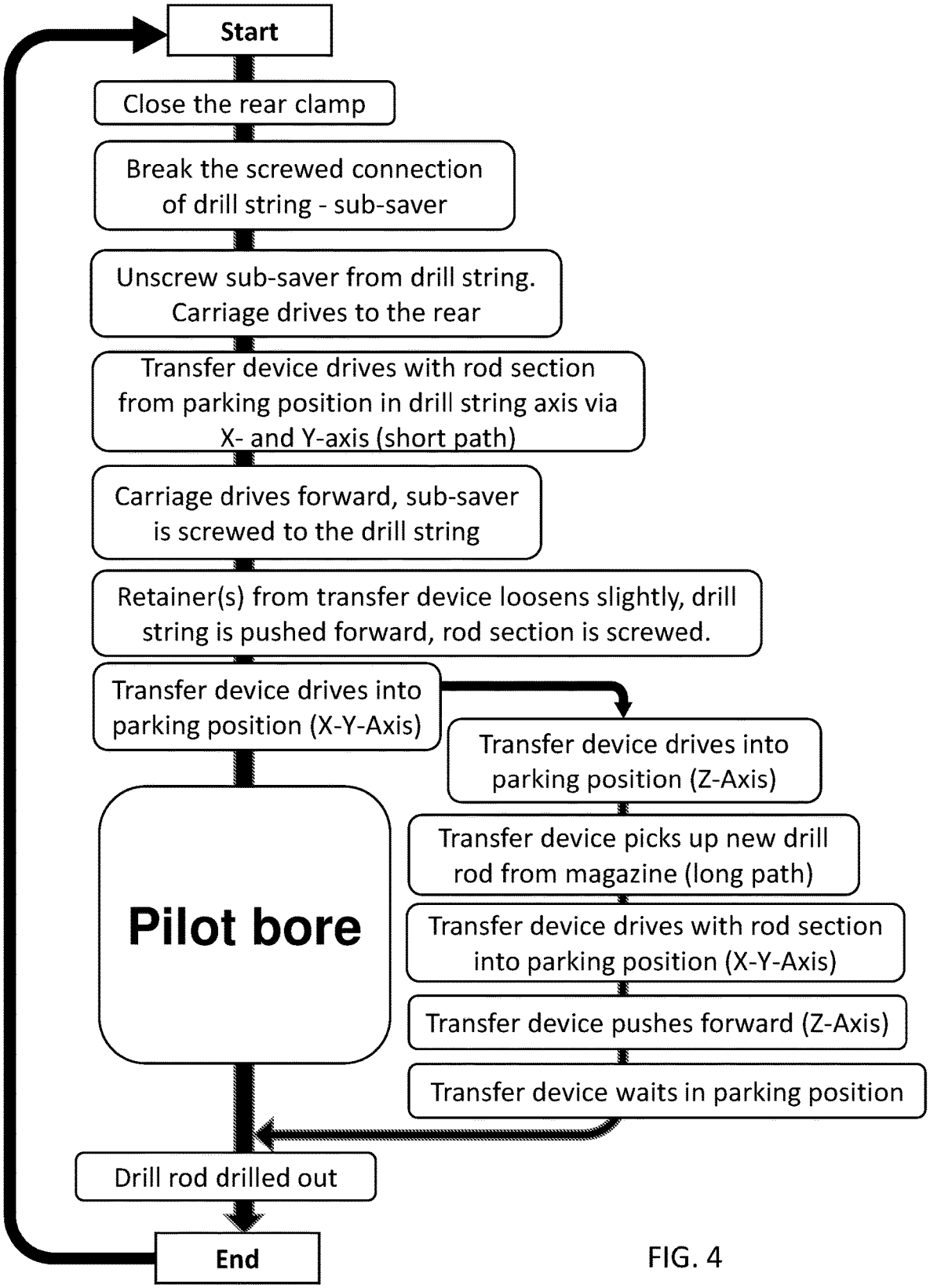
FIG. 4 shows a flow diagram of a bore designed as a pilot bore.

The processes involved in a pilot bore are described in FIG. 4. After completion of the pilot bore, a line to be laid is usually pulled in or the existing pilot bore is widened in order to be able to lay lines with larger diameters.

Figure 5:
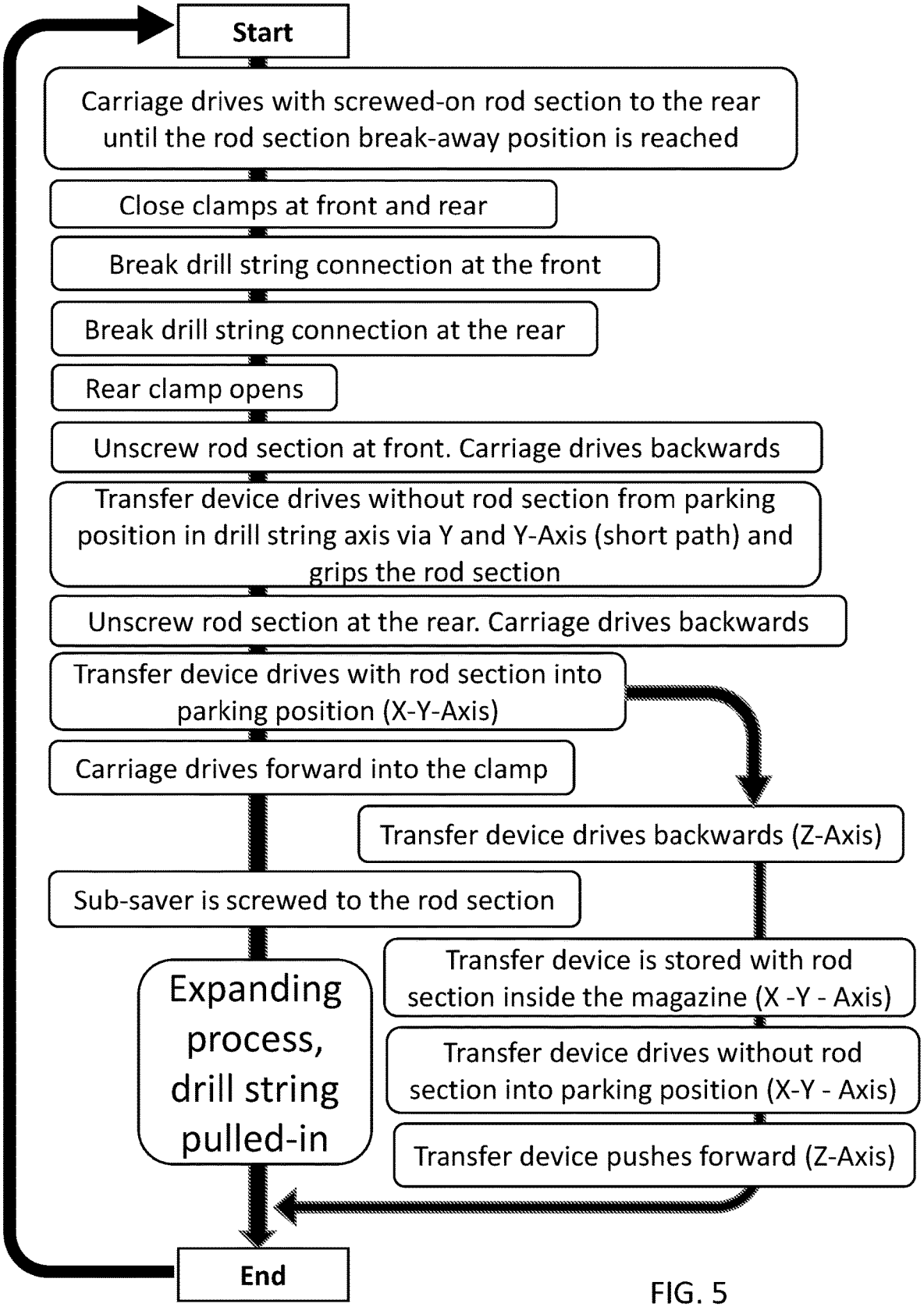
FIG. 5 shows a flow chart of a ground bore designed as an expansion bore.

The processes in this case take place more or less in the opposite direction, as explained in FIG. 5. Before the removal of a rod section 7 from the drill string 6 to shorten it, the transfer device 9 again assumes the already described intermediate position in order to be able to reach the longitudinal axis L of the drill string 6 over a short distance and thus in a short time in order to be able to grip a withdrawn rod section 7. The rod section 7 is then deposited parallel to the progress of the drawing-in, i.e. without interrupting the actual operating steps. The intermediate position is selected in such a way that a residual quantity of drilling fluid which runs out of a rod section 7 is caught when this rod section 7 is removed from the drill string 6 and fed back into the drilling process.

The invention claimed is:

1. A control for at least one retainer of a transfer device for a rod section of a ground drilling device, wherein the control is configured to control the ground drilling device for moving a drill string, and the transfer device is configured for transferring the received rod section from a position in a rod magazine to a position on the drill string or vice versa, and the control is configured to move the at least one retainer between a position above the rod magazine and the position on the drill string while the drill string is still moving, wherein a storage for the rod section is provided on the travel path between the position above the rod magazine and the position on the drill string, and wherein the transfer device is configured to place the rod section on the storage and to pick up the rod section from the storage.

2. The control of claim 1, wherein said storage is positioned above a fluid collection container for drilling fluid.

3. The control of claim 1, wherein the control is configured to move the transfer device both transversely and longitudinally parallel to the drill string or an axis of the drill string.

4. The control of claim 1, wherein the control is configured for sorting the rod sections in the rod magazine.

5. A transfer device for a rod section of a ground drilling device, wherein the ground drilling device is configured to move a drill string, and the transfer device has at least one retainer for the rod section and is configured for transferring the received rod section from a position in a rod magazine to a position on the drill string or vice versa, and the transfer device is configured to be controlled by a control, wherein the control is configured to move the at least one retainer between a position above the rod magazine and the position on the drill string while the drill string is still moving, wherein a storage for the rod section is provided on the travel path between the position above the rod magazine and the position on the drill string, and wherein the transfer device is configured to place the rod section on the storage and to pick up the rod section from the storage.

6. A ground drilling device having a control, and a transfer device, wherein the ground drilling device is configured for moving a drill string, and the transfer device has at least one retainer for a rod section and is configured for transferring the received rod section from a position in a rod magazine to a position on the drill string or vice versa, and the control is configured to move the at least one retainer between a position above the rod magazine and the position on the drill string while the drill string is still moving, wherein a storage for the rod section is provided on the travel path between the position above the rod magazine and the position on the drill string, and wherein the transfer device is configured to place the rod section on the storage and to pick up the rod section from the storage.

7. A method for transferring a rod section using the ground drilling device of claim 6, the method comprising:

(a) receiving the rod section by the at least one retainer;

(b) transferring the rod section from a position in the rod magazine to a position on the drill string or vice versa by the transfer device.

* * * * *